US008746516B2

(12) United States Patent
Wagner et al.

(10) Patent No.: US 8,746,516 B2
(45) Date of Patent: Jun. 10, 2014

(54) TUNDISH IMPACT PAD

(75) Inventors: Thomas Wagner, Borken (DE); Karsten Langer, Bochum (DE)

(73) Assignee: Vesuvius Crucible Company, Wilmington, DE (US)

( * ) Notice: Subject to any disclaimer, the term of this patent is extended or adjusted under 35 U.S.C. 154(b) by 435 days.

(21) Appl. No.: 13/132,327

(22) PCT Filed: Nov. 30, 2009

(86) PCT No.: PCT/EP2009/008512

§ 371 (c)(1),
(2), (4) Date: Jun. 2, 2011

(87) PCT Pub. No.: WO2010/063431

PCT Pub. Date: Jun. 10, 2010

(65) Prior Publication Data

US 2011/0240689 A1 Oct. 6, 2011

(30) Foreign Application Priority Data

Dec. 2, 2008 (EP) ..... 08170497

(51) Int. Cl.
*B22D 41/00* (2006.01)
*B22D 37/00* (2006.01)

(52) U.S. Cl.
USPC ..... 222/591; 266/236; 222/590; 222/594

(58) Field of Classification Search
USPC ..... 222/590, 591, 594; 266/236
See application file for complete search history.

(56) References Cited

U.S. PATENT DOCUMENTS 5,110,096 A 5/1992 Zacharias
5,868,955 A * 2/1999 Tavernier ..... 222/590

FOREIGN PATENT DOCUMENTS

| | | | |
|---|---|---|---|
| EP | 0790873 | B1 | 6/1998 |
| EP | 0847820 | A1 | 6/1998 |
| EP | 0729393 | B1 | 8/1999 |
| EP | 0847313 | B1 | 10/1999 |
| EP | 0894035 | B1 | 9/2001 |
| EP | 1198315 | B1 | 10/2003 |
| EP | 1397221 | A1 | 3/2004 |
| EP | 1490192 | B1 | 12/2006 |
| WO | 2008/093042 | A1 | 8/2008 |

* cited by examiner

*Primary Examiner* — Lois Zheng
(74) *Attorney, Agent, or Firm* — Thomas Clinton; Donald M. Satina

(57) ABSTRACT

An impact pad, for use in a T-shaped tundish, comprises a base having an impact surface and an outer side wall extending upwardly therefrom and defining an interior space having an upper opening for receiving a stream of molten metal, the interior space being divided into two regions by a separating wall provided with at least one passageway for the molten metal stream. The separating wall is at least three times higher than the outer side wall and is inclined with respect to the vertical. This impact pad increases the homogeneity of the molten steel cast from the different outlets of the T-shaped tundish and provides equal or relatively similar residence times of the molten steel discharged through the different outlets of the tundish. This impact pad also permits a fast transition of the steel quality at ladle change while retaining the advantages of conventional impact pads.

10 Claims, 3 Drawing Sheets

TUNDISH IMPACT PAD

BACKGROUND OF THE INVENTION (1) Field of the Invention

The present invention generally relates to the continuous casting of molten metal and in particular to the continuous casting of molten steel. In particular, the present invention relates to tundish vessels and, more particularly, to tundish impact pads designed to inhibit or reduce turbulent flow of molten metal within the tundish.

(2) Description of Related Art

A process for the continuous casting of molten metal is well known in the art. This process will now be described with reference to steel, but it is to be understood that the present invention is not limited to the continuous casting of molten steel. In particular, the present invention can also be used with other alloys or molten metals such as iron or even non-ferrous metals. In this known process, molten steel is poured into a transport ladle that conveys the molten metal to the casting apparatus. The ladle is provided with a discharge orifice in its bottom wall. Generally a sliding gate arranged just below the discharge orifice is used to control the flow of molten steel towards a tundish. To prevent the oxidation of the molten steel discharged from the ladle into the tundish, a ladle shroud is generally connected to the sliding gate to transfer the molten steel sheltered from the surrounding atmosphere. The bottom end of the ladle shroud is normally immersed into the tundish steel bath.

The tundish is an intermediate metallurgical vessel receiving the molten steel discharged from the pouring ladle. In turn, the tundish distributes the molten steel into one or more casting molds arranged below the tundish. The tundish is used for separating slags and other contaminants from the molten steel. The molten steel flows along the tundish toward one or more outlets discharging the molten steel into the said one or more casting molds. The length of the tundish is selected to provide a time of residence of the metal in the tundish sufficient to allow separation of the inclusions as a floating slag layer. The flow of molten steel discharged from the tundish is generally controlled, most often with a stopper, and, as for the steel discharged from the ladle, is generally shrouded with a nozzle conveying the molten steel from the tundish into the casting mold.

The present invention is of particular value for a specific tundish design wherein the molten steel stream is introduced into the tundish in a pour area consisting in a side extension of the tundish main body. This side extension is in fluid connection with the tundish main body. Such a tundish is often called T-shaped tundish (when viewed in plan, the cross-bar or top of the "T" corresponds to the main body of the tundish and so is of greater length than the tail or vertical of the "T"). The area inside the tundish in the region of the tail of the "T" (the side extension) is usually the pour area where molten steel is introduced into the tundish. This region, therefore, normally has a special erosion-resistant impact pad on the floor. In a variant of the T-shaped tundish (sometime called h-shaped tundish), the tail or pour area is arranged obliquely (or even parallel) with respect to the tundish main body. In the context of the present invention, any such tundish will be designated as T-shaped tundish.

This type of tundish is generally provided with an even number of outlets which are symmetrically arranged in the bottom floor of the tundish with respect to the tundish center. For example, in the case of a bloom caster, four to six outlets are generally provided in the tundish floor.

One significant problem often encountered with this type of tundish is the difference of flow velocity of the streams discharged from the different outlets. In other words, the residence time of the molten steel in the tundish is significantly longer for the outlets further away from the tundish center than for the outlets which are closer to the tundish center. In turn, this gives rise to steel quality problems and more particularly to a significant difference of quality between the steel discharged from the different outlets.

Another problem is the speed of the transition at ladle change. Indeed, due to the different velocities of the streams discharged through the different outlets, the transition is much longer for the outer streams than for the center streams.

Pouring pads placed within tundishes have been widely used to prevent damage to the working and safety linings of a tundish by the force of the incoming stream of molten metal. The kinetic energy of the incoming stream of molten metal also creates turbulence which can spread throughout the tundish if the flow of molten metal is not properly controlled. Many times, this turbulence has a detrimental effect on the quality of cast products formed from metal taken from the tundish. More specifically, turbulent flow and high velocity flow within the tundish can, for example, have the following harmful effects:

1. excessive turbulence can disturb the steel surface and promote emulsification of the slag at ladle changes or during operation of the tundish with a relatively low level of molten metal;

2. high velocities produced by turbulent flow in the pouring area can cause erosion of the working lining of the tundish which is typically comprised of a refractory material having a much lower density than impact pads;

3. highly turbulent flow within the tundish can impede the separation of inclusions, especially inclusions less than 50 microns in size, due to the fluctuating nature of such turbulent flows;

4. high speed flows may also increase the possibility of slag being directed into a mold through increased vortexing of the molten metal in the tundish which draws slag downwardly toward the outlet;

5. turbulent flow within the tundish may result in disturbance of the slag/metal interface near the top of the metal bath and thereby promote slag entrainment as well as the possibility of opening up an "eye" or space within the slag layer which can be a source of reoxidation of the molten metal;

6. high levels of turbulence in the tundish can be carried down into the pouring stream between the tundish and the mold. This can cause "bugging" and "flaring" of the pouring stream which thereby lead to casting difficulties;

7. high velocity flow in the tundish has also been attributed to a condition known as "short circuiting". Short circuiting refers to the short path a stream of molten metal may take from the ladle to the impact pad to the nearest outlet in the tundish. This is undesirable since it reduces the amount of time inclusions have to be dissipated within the bath. Instead, the high velocity flow sweeps relatively large inclusions down into the mold where they reduce the quality of the cast products.

A typical flat impact pad causes an incoming ladle stream to impact the top of the pad and travel quickly to the side or end walls of the tundish. When the stream reaches the side and/or end walls, it rebounds upward to the surface of the tundish where it changes direction toward the center of the tundish or, in other words, toward the incoming ladle stream. This creates undesirable inwardly directed circular flows in the tundish. The opposing flows on either side or end of the tundish travel toward the center of the tundish and carry with them slag or other impurities that have floated to the surface of the bath within the tundish. As a result, these impurities are drawn toward the incoming ladle stream and are then forced downwardly into the bath and toward the outlets of the tundish. This tends to cause more of these impurities to exit the tundish into the molds thereby decreasing the quality of the products produced within the molds. In addition, it has been observed that for T-shaped tundishes, flat impact pads cause far too short residence time of the molten steel in the tundish so that the tundish cannot fulfil properly its function.

While numerous types of tundish pads have been proposed and used in the past, none of these fully address all of the problems noted above for T-shaped tundish. Examples of prior tundish pads are disclosed in the following European patents or patent applications: EP-B1-729393, EP-B1-790873, EP-B1-847313, EP-B1-894035, EP-B1-1198315, EP-B1-1490192 and EP-A1-1397221. In particular, even though the residence time of the steel in the tundish is significantly increased, short-circuiting is observed and the steel discharged through the center outlets is significantly faster than the other steel streams.

BRIEF SUMMARY OF THE INVENTION

Therefore, an object of the present invention is to improve the quality of molten steel cast from a T-shaped tundishes and, in particular, to increase the homogeneity of the molten steel cast from the different outlets of a T-shaped tundish (quality at steady state). Another object of the present invention is to permit an improved control of the steel streams velocities in the tundish so as to provide equal or relatively similar residence times of the molten steel discharged through the different outlets of the T-shaped tundish. Yet another object is to permit a fast transition of the steel quality at ladle change. In particular, it would be desirable that the transition in steel quality occurs in a very short period of time amongst the different strands. It would also be desirable to provide these advantages while keeping the advantages of the conventional impact pads (low level of slag emulsification).

According to the invention, there is provided an impact pad, for use in a T-shaped tundish comprising a main body and a tail, formed from a refractory composition capable of withstanding continuous contact with molten metal, the pad comprising a base having an impact surface and an outer side wall extending upwardly therefrom and defining an interior space having an upper opening for receiving a stream of molten metal, the interior space being divided into two regions by a separating wall provided with at least one passageway for the molten metal stream, characterized in that the separating wall is at least three times higher than the outer side wall and is inclined with respect to the vertical.

EP-A1-847820 discloses an impact pad for use in a T-shaped tundish comprising a main body and a tail, formed from a refractory composition capable of withstanding continuous contact with molten metal. This impact pad is intended to be used in a conventional tundish with a raised portion. The molten steel is poured in a first region of the impact pad and flows towards a second region of the pad through an opening in a wall separating the two regions. Then, the molten metal flows back towards the first region by running over the separating wall. Thereby, the stream energy is dissipated. The separating wall is straight and at most as high as the outer side wall. There is no indication that such an impact pad could be modified or that it could be used in a T-shaped tundish.

It has been observed that the impact pad according to the invention solves most of the above mentioned problems. In particular, high quality at steady state, fast transition and low slag emulsification have been observed with this impact pad. Further, the impact pad according to the invention provides a better thermal stratification. This is because of the much faster flow to the outer strands compared to other impact pads.

According to the invention, the separating wall extends upwardly above the height of the outer wall of the impact pad by at least three times, preferably by at least four times. According to one embodiment, the separating wall extends upwardly at least up to a height corresponding to the height of the molten metal level in the tundish in which the impact pad is contained. In this case, it is preferable to provide the upper portion of the wall with a thickened portion about the level of molten metal in the tundish so as to increase the slag resistance of the separating wall. This thickened portion will be located in the upper half, preferably, the upper quarter of the separating wall.

The separating wall is inclined with respect to the vertical, preferably of an angle corresponding to the inclination of the tundish walls in the main body of the tundish. Thereby, the operator can easily provide a tight joint between the separating wall and the tundish walls during the tundish set up. Typical angles range from 1 to 15°, say 6°.

According to another variant, the separating wall has a width corresponding to the width of the tail of the tundish in the region of the junction between the main body and the tail of the tundish.

According to another embodiment of the present invention, the separating wall extends upwardly at least up to a height corresponding to the height of the molten metal level in the tundish and the separating wall has a width corresponding to the width of the tail of the tundish in the region of the junction between the main body and the tail of the tundish. Thereby, the separating wall divides the tundish into a tail and a main body communicating mainly through the passageway of the separating wall.

It is to be understood that the passageway in the separating wall should preferably constitute the main passageway for the passage of molten metal from the tail towards the main body of the tundish. Nevertheless, the passage of a limited quantity (say less than 20%) of molten metal around or above the separating wall would also provide beneficial effects.

The base, outer wall and separating wall can be integral but, in order to facilitate the transportation and assembly, it is preferable to provide separately the separating wall on the one hand and the base and outer wall on the other hand. In this case, it is advantageous to provide the separating wall with at least one slot adapted for engagement with a corresponding portion of the outer wall. Similarly, the outer wall can be provided with at least one slot adapted for receiving at least a corresponding portion of the separating wall. In a variant, both the outer wall and the separating wall are provided with a slot adapted for engagement with a corresponding portion respectively of the separating wall and outer wall.

When the separating wall on the one hand and the base and outer wall on the other hand are provided separately, it might be advantageous to provide the base and outer wall component with at least one inclined slot, comprising a channel having an inclination with respect to the vertical, adapted for receiving at least a corresponding portion of a separating wall, and conferring to the separating wall an inclination with respect to the vertical.

According to another of its object, the invention relates to the assembly of a T-shaped tundish comprising a main body and a tail with an impact pad as above described wherein the impact pad has a separating wall extending upwardly at least up to a height corresponding to the height of the molten metal level in the tundish and having a width corresponding to the width of the tail of the tundish in the region of the junction between the main body and the tail of the tundish, the separating wall dividing the tundish into a tail and a main body communicating mainly through the passageway of the separating wall.

BRIEF DESCRIPTION OF THE SEVERAL VIEWS OF THE DRAWINGS

The invention will now be described on the basis of the accompanying figures, wherein.

DETAILED DESCRIPTION OF THE INVENTION

Figure 1:
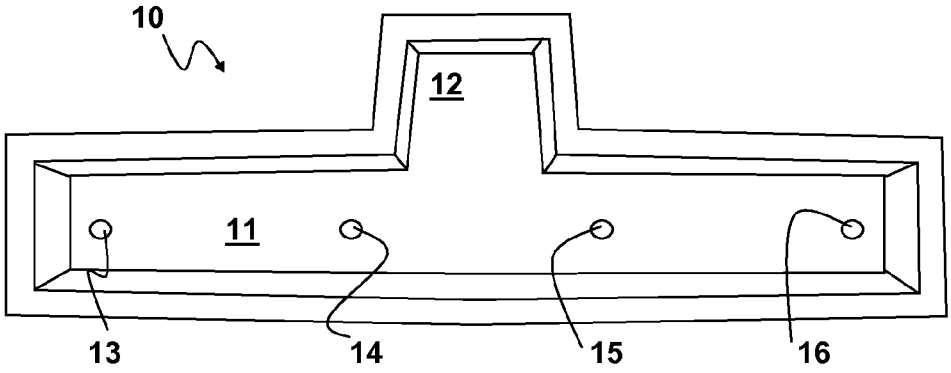
Fig. 1 (prior art)
FIG. 1 shows a top view of a T-shaped tundish.
Figure 2:
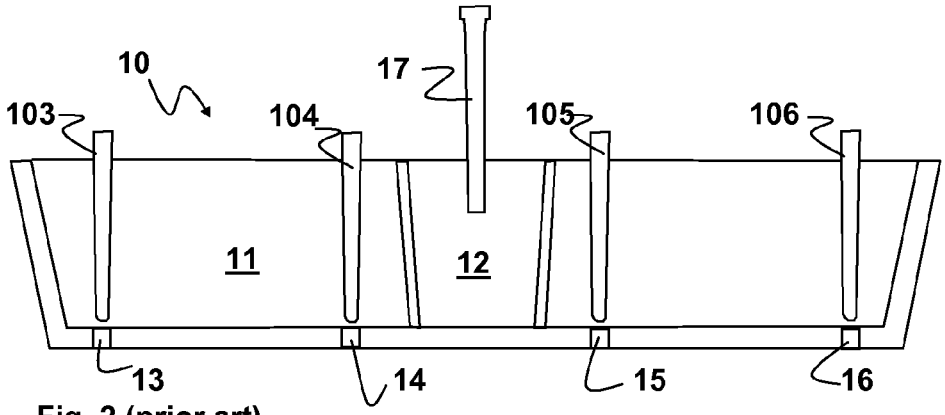
Fig. 2 (prior art)
FIG. 2 shows a cross-section of the tundish of FIG. 1.

FIGS. 1 and 2 show a conventional T-shaped tundish 10 comprising a main body 11 and a tail 12. The molten steel stream is discharged into the tail 12 of the tundish 10 from a ladle (not shown) through a ladle shroud 17. The tundish 10 is provided with four outlets (13-16) which are symmetrically arranged in the bottom floor of the tundish. The two outlets 14 and 15 are closer to the ladle shroud 17 and thus closer to the incoming stream. The molten metal flow discharged from the tundish 10 is controlled with the stoppers 103-106.

Figure 3:
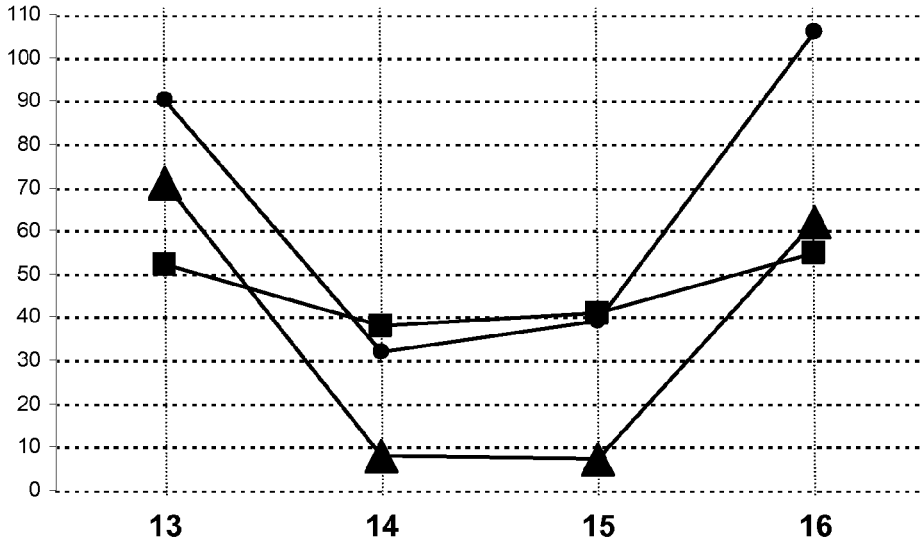
FIG. 3 depicts the minimum residence time in the tundish for each strand at steady state.

FIG. 3 shows, for each of the outlets 13-16, the minimum residence time (in seconds) of the molten metal measured on a tundish at steady state without any impact pad (▲), for a tundish with a conventional impact pad without separating wall (●) and for a tundish according to the invention (■). This chart indicates that the minimum residence time is advantageously increased with the provision of an impact pad. Also visible is the fact that when an impact pad according to the present invention is used, the residence time of the molten steel cast through all the outlets is much more homogeneous; i.e. the residence time of the molten steel discharged from the outer outlets (13, 16) is comparable to the residence time of the molten steel discharged from the center outlets (14, 15) while, in the same conditions, the residence time of the molten steel discharged from the outer outlets is from 3 to 6 times higher with no impact pad or with a conventional impact pad.

Figure 4:
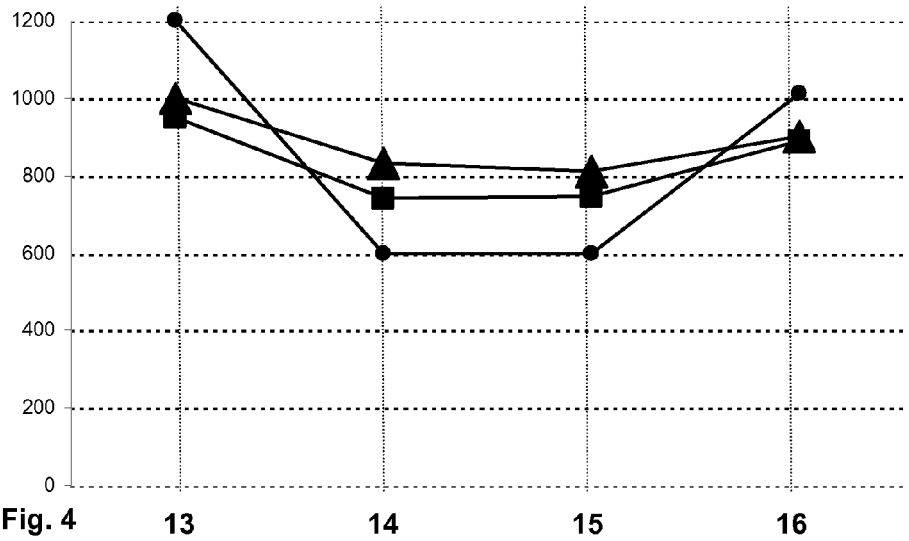
FIG. 4 depicts the transition time in the tundish for each strand at ladle change.

FIG. 4 shows for each of the outlets 13-16 the transition time (in seconds) of the molten metal at ladle change measured on a tundish without any impact pad (▲), for a tundish with a conventional impact pad without a separating wall (●) and for a tundish according to the invention (■). This chart shows that for both the tundish without an impact pad or with an impact pad according to the invention, the transition times for the different outlets (13-16) are comparable while for a tundish provided with a conventional impact pad, the transition time for the center outlets (14, 15) is almost the double of the transition time for outer outlets (13, 16). It is also visible that the transition time for the different outlets is generally lower for a tundish provided with an impact pad according to the invention.

Figure 5:
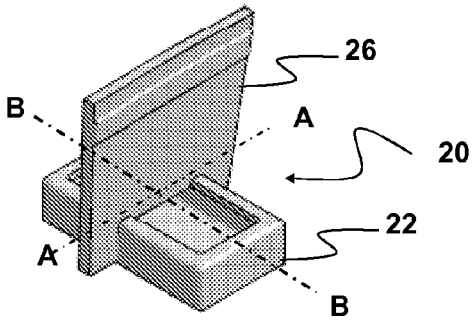
FIG. 5 shows a perspective view of the impact pad according to the invention.
Figure 6:
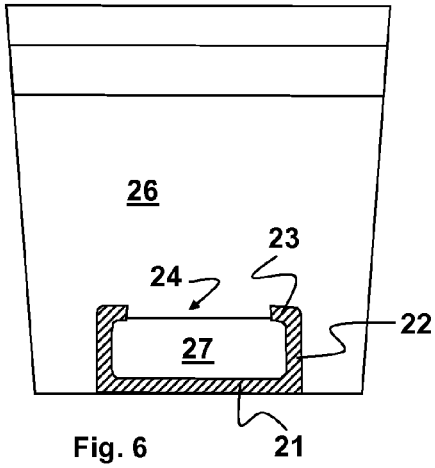
FIG. 6 shows a cross-section of the impact pad of FIG. 5 according to the direction A-A.

FIGS. 5 to 6 show the impact pad 20 according to the invention which comprises a base 21 and an outer side wall 22 defining an interior space having an upper opening 24. On these figures, the outer side wall 22 is provided with an overhang 23 extending above the interior space and the outer wall 22 is endless and continuous. It is to be understood that these features are not essential. I.e., the overhang can be absent or of a different shape and the outer wall can be provided with one or more orifices for the molten steel.

Figure 7:
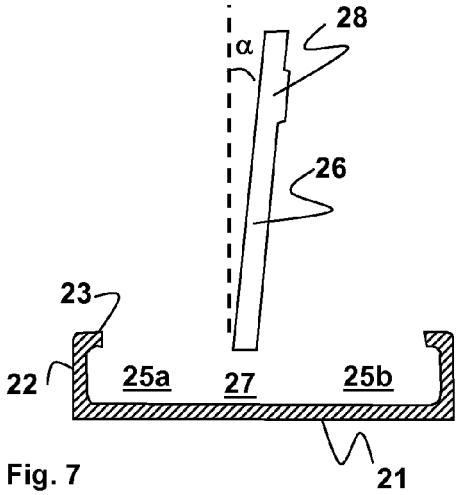
FIG. 7 shows a cross-section of the impact pad of FIG. 5 according to the direction B-B.

The interior space of the impact pad 20 is divided into two regions 25*a*, 25*b* by a separating wall 26 provided with a passageway 27 for the molten metal stream. In these figures, the separating wall extends upwardly beyond the outer side wall to an extent of at least two times, at least three times, or about four times the height of the outer side wall. The separating wall 26 is also provided with a thickened portion 28 about the level of molten metal in the tundish (i.e. in the upper quarter of the separating wall). Also visible on FIG. 7 is the inclination of the separating wall 26 of an angle $\alpha$ with respect to the vertical. In this figure, the angle $\alpha$ is of about 6° and corresponds to the tundish wall inclination.

Figure 8:
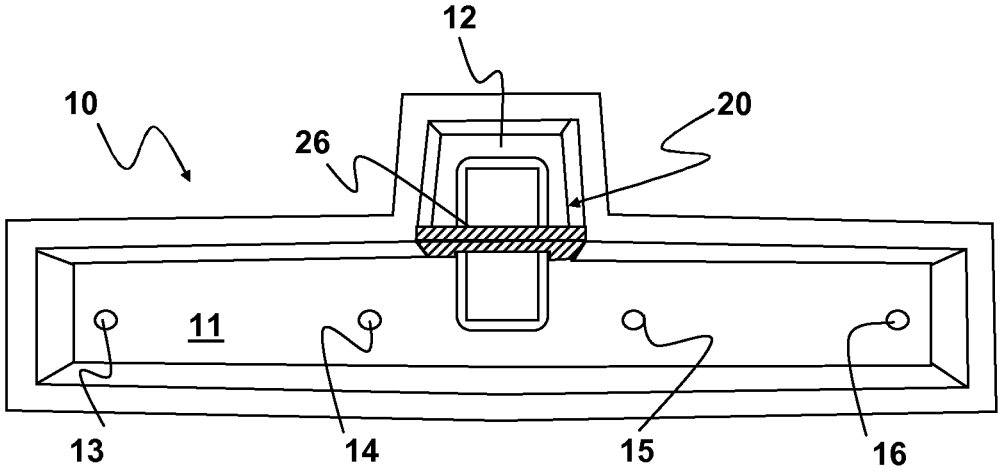
FIG. 8 shows a top view of an assembly according to the invention.
Figure 9:
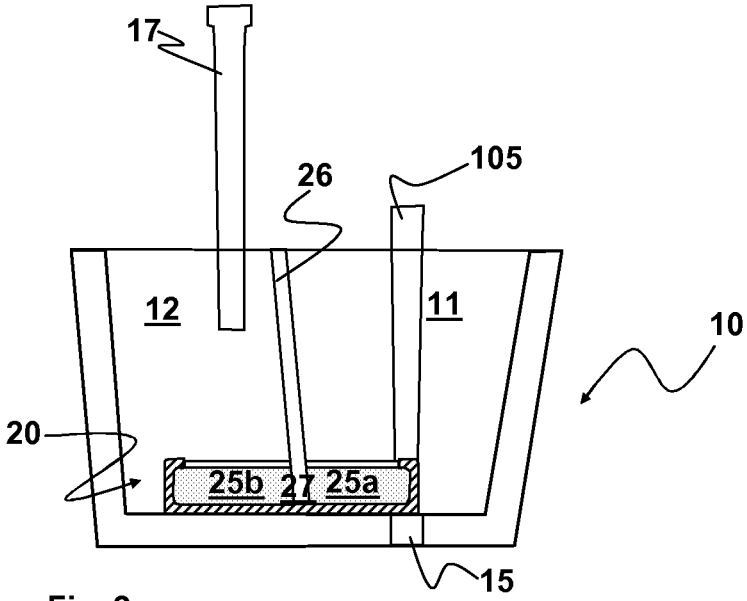
FIG. 9 shows a cross-section of the assembly of FIG. 8.

The impact pad 20 and its position in the tundish 10 are also visible in the assembly of FIGS. 8 and 9. These figures show the impact pad 20 arranged with the separating wall 26 extending upwardly up to a height corresponding to the height of the molten metal level in the tundish and having a width corresponding to the width of the tail 12 of the tundish in the region of the junction between the main body 11 and the tail 12 of the tundish so that the separating wall 26 divides the tundish into a tail 12 and a main body 11 communicating mainly through the passageway 27.

Thus, the molten metal is discharged from the ladle (not shown) through the ladle shroud 17 into the region 25*b* of the impact pad positioned in the tundish tail 12. The molten stream flows through the passageway 27 of the separating wall 26 and reaches first the region 25*a* of the impact pad 20 positioned in the tundish main body 11 and is distributed into the tundish main body 11. The molten steel is then discharged through the outlets 13-16.

It has been observed that the slag emulsification profile observed with an impact pad according to the invention is much more favorable than without any impact pad and is more favorable than with a conventional impact pad. The slag emulsification is observed by the so-called dye injection test which does not show wedges in the outer upper corners of the tundish which—typically for multi strand tundishes—stay clear for a very long time.

Numerous modifications and variations of the present invention are possible. It is, therefore, to be understood that within the scope of the following claims, the invention may be practiced otherwise than as specifically described.

We claim:

1. Impact pad, for use in a tundish, formed from a refractory composition capable of withstanding continuous contact with molten metal, the pad comprising a base having an impact surface and an outer side wall extending upwardly therefrom and defining an interior space having an upper opening for receiving a stream of molten metal, the interior space being divided into two regions by a separating wall provided with at least one passageway for the molten metal stream, wherein the separating wall is at least three times higher than the outer side wall and is inclined with respect to the vertical.

2. Impact pad according to claim 1, wherein the separating wall comprises a thickened portion arranged in the upper half of the separating wall.

3. Impact pad according to claim 2, wherein the separating wall comprises a thickened portion arranged in the upper quarter of the separating wall.

4. Impact pad according to claim 1, wherein the separating wall is provided with at least one slot adapted for engagement with a corresponding portion of the outer wall.

5. Impact pad according to claim 1, wherein the outer wall is provided with at least one slot adapted for receiving at least a corresponding portion of the separating wall.

6. Impact pad according to claim 1, wherein the base, outer wall and separating wall are integral.

7. Impact pad component comprising a base having an impact surface and an outer side wall extending upwardly therefrom and defining an interior space having an upper opening for receiving a stream of molten metal, wherein the outer wall is provided with at least one inclined slot comprising a channel having an inclination with respect to the vertical, wherein the slot is adapted for receiving at least a corresponding portion of a separating wall.

8. Assembly of a T-shaped tundish comprising a main body and a tail with an impact pad according to claim 1 contained within the tundish, wherein the impact pad comprises a separating wall extending upwardly, the separating wall dividing the tundish into a tail and a main body communicating mainly through a passageway of the separating wall.

9. Assembly according to claim 8, wherein the separating wall has a width corresponding to the width of the tail of the tundish in the region of the junction between the main body and the tail of the tundish.

10. Assembly according to claim 8, wherein the separating wall is inclined at an angle corresponding to the inclination of the tundish walls in the main body of the tundish.

* * * * *